US005255499A

United States Patent [19]

Hodsdon

[11] Patent Number: 5,255,499

[45] Date of Patent: Oct. 26, 1993

[54] RACE HORSE HARNESS ATTACHMENT FOR SULKIES

[76] Inventor: Erwin P. Hodsdon, 1 Pleasant St., Bridgton, Me. 04009

[21] Appl. No.: 962,865

[22] Filed: Oct. 19, 1992

[51] Int. Cl.[5] ..... B68B 1/00

[52] U.S. Cl. ..... 54/2; 54/39.1

[58] Field of Search ..... 54/2, 50, 39.1; 280/63, 280/75, 76

[56] References Cited

U.S. PATENT DOCUMENTS

| | | | |
|---|---|---|---|
| 921,587 | 5/1909 | Chaney | 54/50 |
| 3,907,325 | 9/1975 | Gaines et al. | 280/63 X |
| 5,056,301 | 10/1991 | Garland et al. | 54/2 |
| 5,081,826 | 1/1992 | MacKay | 54/2 |

*Primary Examiner*—Robert P. Swiatek
*Attorney, Agent, or Firm*—Laforest S. Saulsbury

[57] ABSTRACT

A race horse harness attachment for securing a sulky by its thills to the harness piece about a race horse to limit the pivot of the attachment to rotating about a single horizontal axis whereby the horse may rear without breakage of the thills of the sulky. The attachment includes cup-shaped members extending horizontally from the opposite sides of a base plate and horizontally with the ground into which are detachably-extended inwardly-bent members. These members have an axially adjustable connection with the thills of the sulky to adapt the bridle connection for different size horses. A cotter pin extends through the cup-shaped members for engagement with a groove in the inwardly-bent attaching members to hold the members against axial displacement while permitting their rotation. A substantially rigid connection of the sulky with the bridle is provided wherein rotation is permitted in but one direction rather than in many directions as with ball and socket connections.

6 Claims, 2 Drawing Sheets

Figure 1:
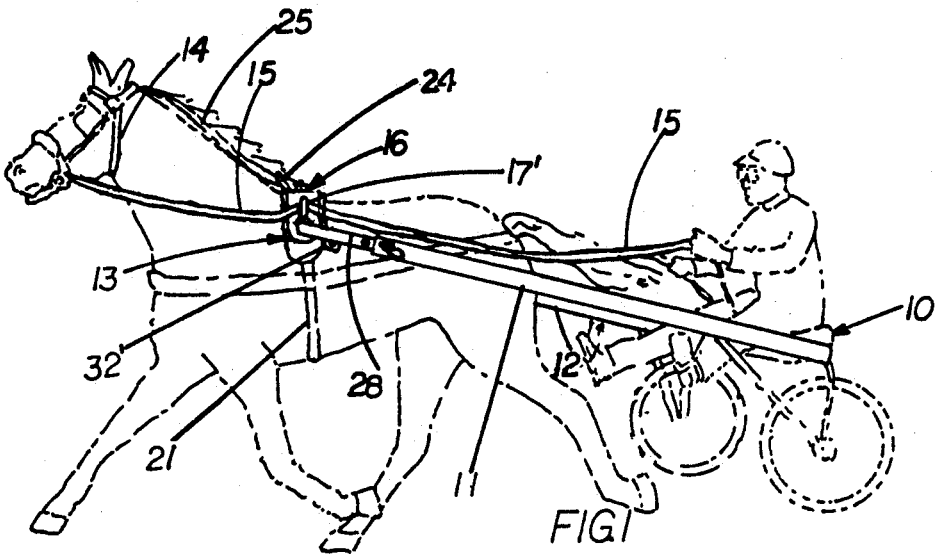

FIG. 4
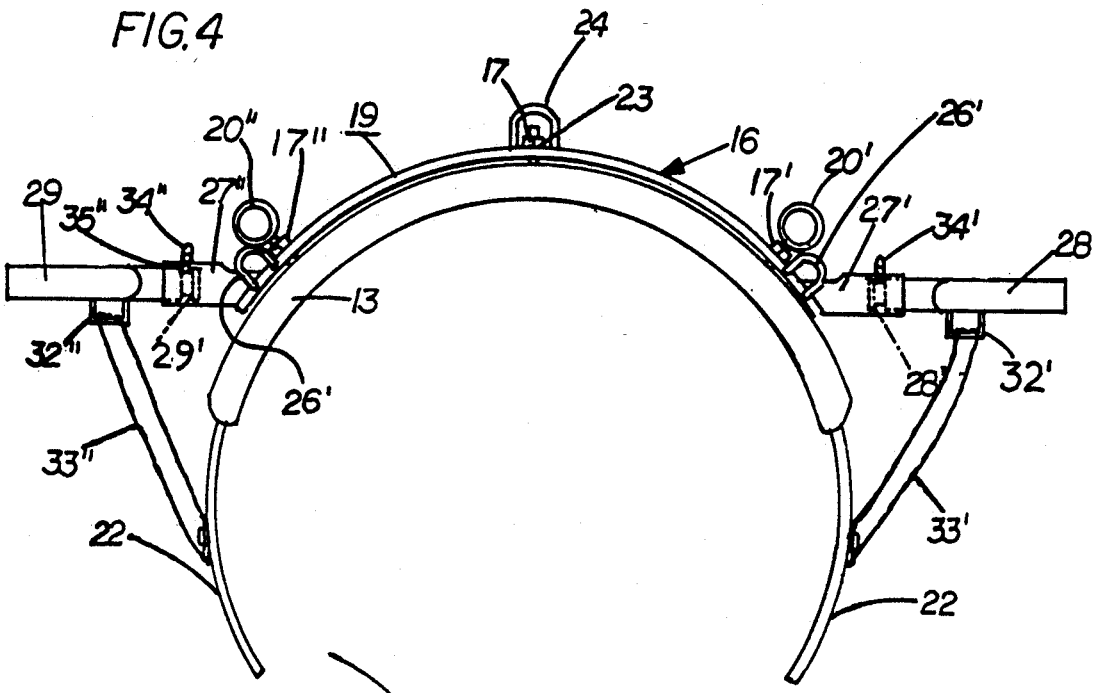
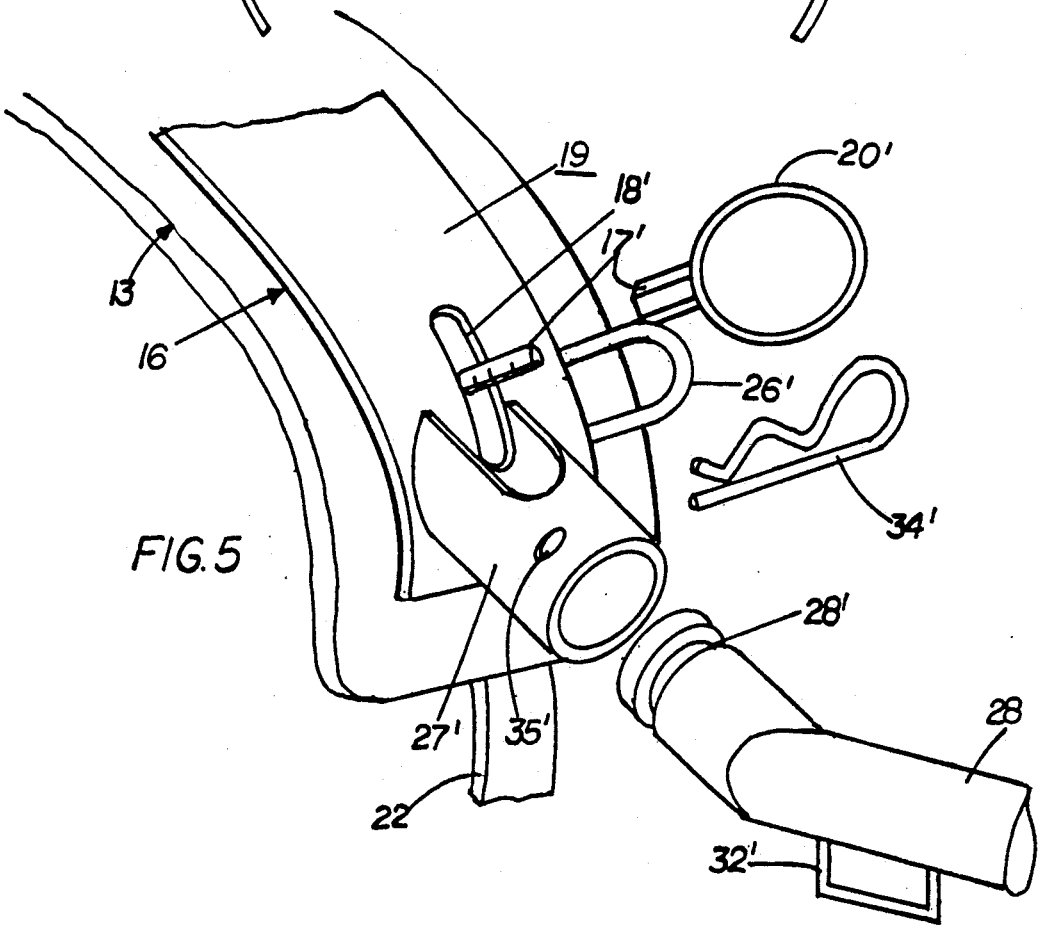
FIG. 5

RACE HORSE HARNESS ATTACHMENT FOR SULKIES

This invention relates to a race horse sulky harness that fits to the harness of the race horse to receive the thills of the sulky.

Heretofore, thills or shafts of the sulky have been rigidly connected to the horse harness. That does not give the horse the freedom of movement needed to move through the turns of a racetrack without effecting fish-tail and the upsetting of the horse and sulky. Such a rigid cupling of the thills with the harness which is tight upon the horse never permits relative movement of the horse with regard to the thills. With a fixed cupling, the horse rears and rigidly takes with him the thills or shafts and their breakage often happens. The horse while running moves from side to side and its weight shifts at the same time from side to side. This motion causes the sulky to fish-tail or zig-zag on the track and the horse's energy is thereby wasted. Also, a skidding of the sulky results when the horse and sulky are making a turn or changing from lane to lane. Ball joints have been used in the connections between the thills or shafts to the horse's harness. It is found that with ball joints too much freedom is provided to the horse and an effective pull upon the sulky does not result. Drivers of the sulkies have to be provided with a sense of integration between the horse, sulky and driver. Ball joint connections destroy the ability of the connection to transmit any feeling of the horse's movement to the driver and properly control the horse while racing. With ball joints the sulky will not precisely track the horse and will permit relative movement of the shaft on the horse in too many directions.

Accordingly, it is the principal object of the present invention to provide a connection of the thills or shafts with the harness that permits rotation only in a single up and down direction and not in a universal manner as with a ball joint.

It is another object of the invention to provide such a cupling with pivotal movement only for the up and down movement of the horse that permits rearing of the horse without undue breakage of the shafts of the sulky.

It is still another object of the invention to provide a cupling for the thills with the horse's harness wherein the horse's harness can be readily made use of to support an attachment that can be connected to the top of the bridle and render the harness effective for use with sulky race horses.

It is a further object of the invention to provide a simple attachment construction so that the assembly can be made with a thrust of a pivot pin projection into a cylinder extending horizontally to the ground from a plate attachment upon the harness and also wherein adjustment to accommodate different length horses can be made between the cupling structure and the respective side shafts of the sulky.

Still further objects of the invention are to provide a cupling for the connection of sulky thills to horse harness which has the above objects in mind, that is of simple construction, easy to assemble the sulky shafts thereupon, pleasing in appearance, has a minimum number of parts and is efficient and effective in use.

Figure 2:
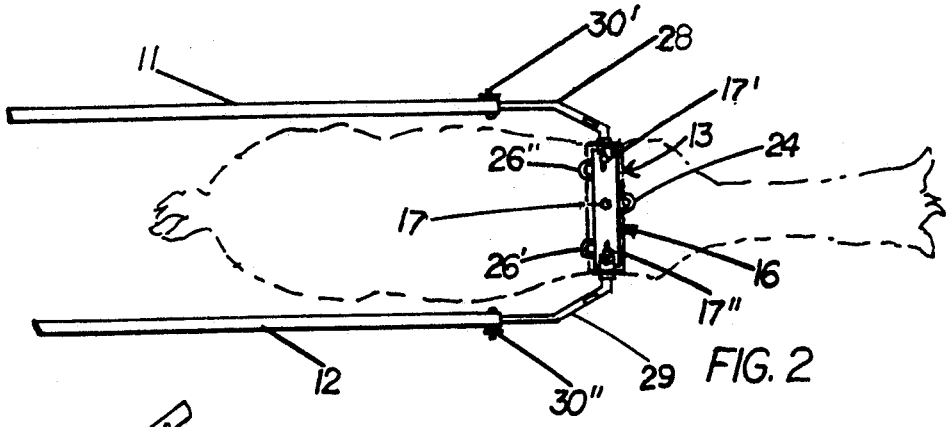
Figure 3:
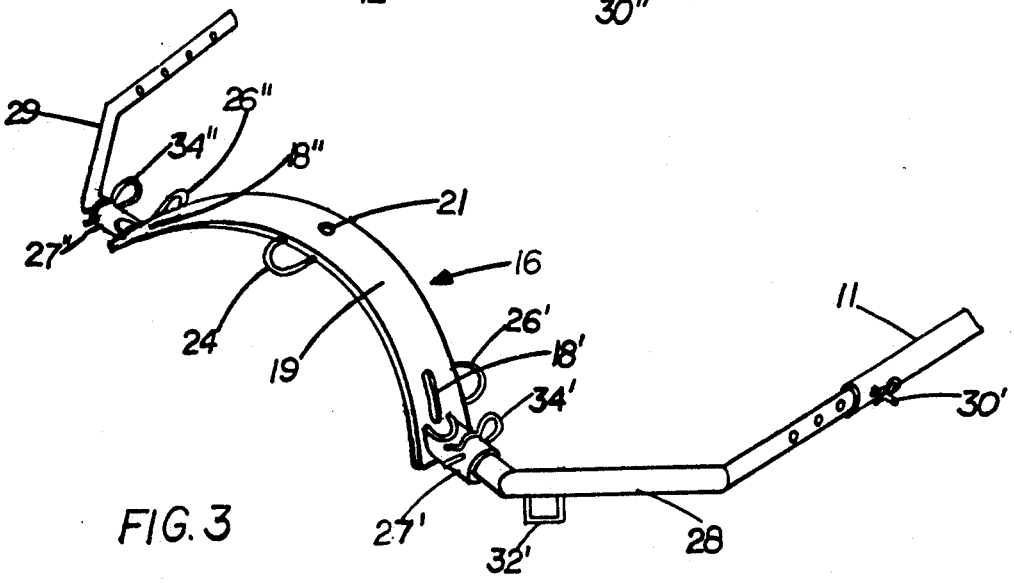

For a better understanding of the invention, reference may be had to the following detailed description taken in connection with the accompanying drawings, in which FIG. 1 is a perspective view of a sulky with my novel pivotal cupling for the connection of sulky thills or shafts to the horse's harness, FIG. 2 is a fragmentary plan view looking down upon the horse and upon the pivotal cupling connection for the bridle with the sulky shafts, FIG. 3 is a perspective view of the attachment for the harness having the cupling connection for each of the shafts respectively extending from the respective opposite side ends thereof, FIG. 4 is a rear elevations view of the attachment fixed to the top of the harness and with safety straps connected to the belly girt, FIG. 5 is an enlarged fragmentary exploded view of one side of the attachment with parts separate and shown in perspective.

Referring now to the figures, 10 represents a two-wheeled sulky that has forwardly-extending thills or shafts 11 and 12 extending forwardly from the wheeled body which carries the driver. The horse will have the usual harness, including a bridle halter 14 and reins 15 extending from the halter to the driver to hold in his hands. The invention is in the form of a plate assembly attachment 16, FIG. 3, adapted to be extended over the top of a girt-held harness piece 13 and be secured thereto by bolt and ring nut assemblies 17' and 17'' extending from the harness piece 13 through corresponding end slots 18' and 18'' in a base plate 19 that conforms to the top surface of the harness piece 13. The bolt and nut assemblies 17' and 17'', respectively, include rings 20' and 20'' through which the hand reins 15 extend.

The harness piece itself is fastened tightly to the horse by a girt strap 21 extending about the belly of the horse. Base plate 19 of the harness piece 13 will be further attached to the harness piece 13 by a bolt and nut assembly 17 at the center that extends upwardly through a hole 21 thereat, FIG. 3. A circular loop 24 is located just forwardly of the hole 21 which will receive a check rein 25 from the bridle halter 14 on the head of the horse. Other loops 26' and 26'' are extended respectively from the respective side ends of the base plate 19 adjacent to the respective slots 18' and 18'' for hooking extra equipment thereto.

For a very simple pivotal connection of the thills 11 and 12 with the base plate 19 there are respectively extended from the side ends of the base plate 19 respective cup-shaped members or cylindrical sleeves 27' and 27'' that are welded to the plate 19. Both of these cup-shaped members extend horizontally with the ground and respectively receive respective inwardly-bent attaching thill-contained members 28 and 29 which are respectively slideably adjustable to fit into the thills 11 and 12 and respectively held by respective screw cotter pins assemblies 30' and 30''. These thill-contained attaching members 28 and 29 are bent or crooked to extend inwardly for pivotal engagement with the cup-shaped or sleeve members 27' and 27''. These attaching members 28 and 29 respectively have respective safety loops 32' and 32'' for the extension of safety straps 33' and 33'' for connection with the girt strap 21 for making sure that the sulky 10 does not become free of the horse if for some reason the attaching members 28 and 29 get detached from the cup-shaped members 27' and 27''.

These thill-contained attaching members 28 and 29 are of solid round stock and respectively have grooves 28' and 29', each groove extending all the way around the stock piece and that are adapted to accept respectively cotter pins 34' and 34'' as the straight sides of the pins are extended through transverse holes 35' and 35'' of the cup-shaped members 27'' and 27'' and so as to lie in the grooves of the respective attaching members 28 and 29 and may permit full rotation of the attaching member within the cup-shaped member. Only rotation in one direction is effected and the thills will be kept tight against the body of the horse as distinguished from what would be ball and socket connections and whereby to provide the necessary firm integration between the horse, sulky and driver.

This present harness attachment gives freedom of movement to the horse, at least in the up and down direction, maintaining thereby a good connection of the sulky to the horse and leaving little lateral wobble between the horse and the sulky. Through such pivot connections the horse can rear without placing great stress upon the thills and causing breakage. The attaching members 28 and 29 are adjustable in the hollow thills so that an adjustment may be made for different lengths of horses. It should be seen that with this connection with the horse the sulky will always be aligned with the horse. There is no freedom for opposite sidewise movements of the horse, but only in the up and down direction of the horse. It should be apparent that this invention is in the form of an attachment that can be fitted to any bridle for the horse. The horse is free to rear and be independent of the sulky without accident to the sulky and driver on occasions.

While various changes may be made in the detail construction, it shall be understood that such changes will be within the spirit and scope of the present invention as defined by the appended claims.

What is claimed is:

1. An attachment for securing a sulky by its thills to a harness piece secured by a girt strap about a horse comprising a curved base plate adapted to be extended over the top of the harness piece, and to be rigidly secured thereto, cup-shaped members respectively extending from the respective opposite side ends of the curved base plate horizontally with the ground and when secured to the harness piece, and inwardly-bent members adapted to be attached to the sulky thills and to be detachably connected to the respective cup-shaped members, said inwardly-bent members having grooves surrounding their connecting ends and cotter pins extendable through said cup-shaped members to lie in the grooves of the inwardly-bent members so as to prevent their axial separation from the cup-shaped members while permitting relative rotation therebetween.

2. An attachment for securing a sulky by its thills to the harness piece about the horse as defined in claim 1 and rein-receiving loops extending from the base plate through which reins from the horse's halter may be extended to the driver in the sulky.

3. An attachment for securing a sulky by its thills to the harness piece about the horse as defined in claim 2 and a further loop extending centrally of the base plate adapted to receive a check rein of the horse extended rearwardly from its halter.

4. An attachment for securing a sulky by its thills to the harness piece about the horse as defined in claim 2 and bolt and nut assemblies for securing the attachment to the harness piece and loops respectively extending from the bolt and nut assemblies.

5. An attachment for securing a sulky by its thills to the harness piece about the horse as defined in claim 1 and said inwardly-bent members having loops and safety straps respectively extending from the respective loops adapted for attachment with the girt strap.

6. An attachment for securing a sulky by its thills to the harness piece about the horse as defined in claim 1 and said inwardly-bent attachment members being respectively connected to the respective thills of the sulky for longitudinal adjustment to accommodate different size horses.

* * * * *